US006570823B1

(12) United States Patent
Gilomen et al.

(10) Patent No.: US 6,570,823 B1
(45) Date of Patent: May 27, 2003

(54) ELECTRONIC CHRONOGRAPH WATCH

(75) Inventors: Beat Gilomen, Grenchen (CH); André Triponez, Lamboing (CH)

(73) Assignee: Eta SA Fabriques d'Ebauches

( * ) Notice: Subject to any disclaimer, the term of this patent is extended or adjusted under 35 U.S.C. 154(b) by 178 days.

(21) Appl. No.: 09/654,992

(22) Filed: Sep. 5, 2000

(30) Foreign Application Priority Data

Sep. 16, 1999 (CH) ..... 1705/99

(51) Int. Cl.[7] ..... G04B 19/04; G04B 23/02; G04F 8/00

(52) U.S. Cl. ..... 368/113; 368/80; 368/110

(58) Field of Search ..... 368/76, 80, 110, 368/112, 113

(56) References Cited

U.S. PATENT DOCUMENTS

| | | | | |
|---|---|---|---|---|
| 2,361,563 A | * | 10/1944 | Pellaton | 368/80 |
| 4,389,122 A | * | 6/1983 | Dubois et al. | 368/110 |
| 4,523,857 A | * | 6/1985 | Ushikoshi | 368/110 |
| 4,623,261 A | * | 11/1986 | Muto | 368/80 |
| 4,748,603 A | * | 5/1988 | Ray et al. | 368/80 |
| 5,113,381 A | * | 5/1992 | Sakamoto et al. | 368/80 |
| 5,220,541 A | * | 6/1993 | Vuilleumier | 368/110 |
| 6,370,087 B1 | * | 4/2002 | Akahane et al. | 368/110 |

FOREIGN PATENT DOCUMENTS

| | | |
|---|---|---|
| EP | 0 617 346 A | 9/1994 |
| EP | 0 678 795 A | 10/1995 |
| GB | 2 166 570 A | 5/1986 |

OTHER PUBLICATIONS

Berney J C: "Quelques Variations Sur La Base Des Mouvements ETA de la Serie 251" Jahrbuch der Deutschen Gesellschaft fur Chronometrie E.V. Stuttgart, vol. 43, Jan. 1, 1992, pp. 135–137, XP000316314.

* cited by examiner

*Primary Examiner*—David Martin
*Assistant Examiner*—Jeanne-Marguerite Goodwin
(74) *Attorney, Agent, or Firm*—Richard K. Robinson

(57) ABSTRACT

The invention concerns electronic chronograph watches which include a central hour hand (3), a central minute hand (4) and a small off-central second hand (6) for permanently indicating the current time, chronograph hands (7, 8, 9) for indicating a measured time when the watch is operating in chronograph mode, drive units for driving said hands and generator means responding to manual control means (P1, P2, 10) to apply control pulses to said drive units. According to the invention, the watch also includes a central second hand (5) driven by its own drive unit and the generator means include means for selectively applying the control pulses to this drive unit, so that the central second hand indicates the seconds of the current time, in phase with the small off-center second hand (6), when the watch is operating normally and the measured seconds when the watch is operating in chronograph mode.

10 Claims, 3 Drawing Sheets

ELECTRONIC CHRONOGRAPH WATCH

BACKGROUND OF THE INVENTION

The present invention relates to electronic chronograph watches.

In many watches of this type, the time is indicated by an hour hand and a minute hand rotating about the centre of the watch and by an off-centre second hand, called small second hand, generally placed at six o'clock.

In certain of these watches the indication of a measured time is achieved by means of a centre second hand concentric to the hour and minute hands for indicating the current time and two other small off-centre hands, situated at ten o'clock and two o'clock, which display the hours, up to 12 or 24 hours, and the minutes, generally up to 30 minutes.

In other watches which allow more precise timing, the measured seconds and minutes and indicated by two large hands concentric to the hour and minute hands for displaying the current time and two small hands at ten o'clock and two o'clock for indicating the hours and tenths or twentieths of a second.

In both cases, these watches have the drawback, all least for certain people who complain of this, of not enabling the indication of the current seconds to be easily read when the watch operates normally, i.e. most of the time.

On the other hand, there also exist electronic chronograph watches wherein the small second hand is omitted and which include a centre second hand which is used for displaying the seconds of the current time when the watch operates normally and the measured seconds when the watch is used in chronograph mode.

These watches which enable the seconds to be easily read in normal time have another drawback.

Indeed, while the watch is operating in chronograph mode, the user no longer has the indication of the seconds of the current time, which may be inconvenient for him, especially when the measured time is long and may last for several hours. For example, if the user wishes to set his watch to the correct time, to the second, while he is using the chronograph function, he cannot.

The object of the present invention is to remove these drawbacks of existing watches and this object is achieved as a result of the features of the chronograph watch defined in the claims.

SUMMARY OF THE INVENTION

Interesting complementary features of the invention are defined in the sub-claims.

BRIEF DESCRIPTION OF THE DRAWINGS

The invention will be better understood upon reading the following description, given by way of example and with reference to the annexed drawings in which.

DETAILED DESCRIPTION OF THE EMBODIMENT

Figure 1:
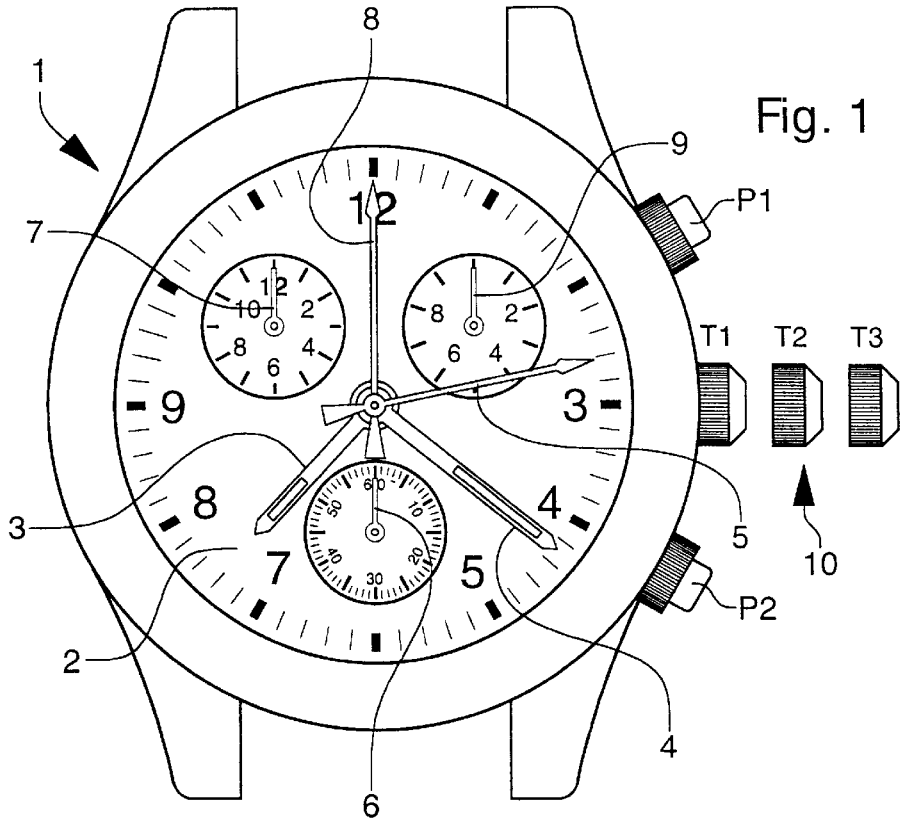
FIGS. 1 and 2 show respectively a chronograph watch and the simplified diagram of its electric circuit according to a first embodiment of the invention.
Figure 2:
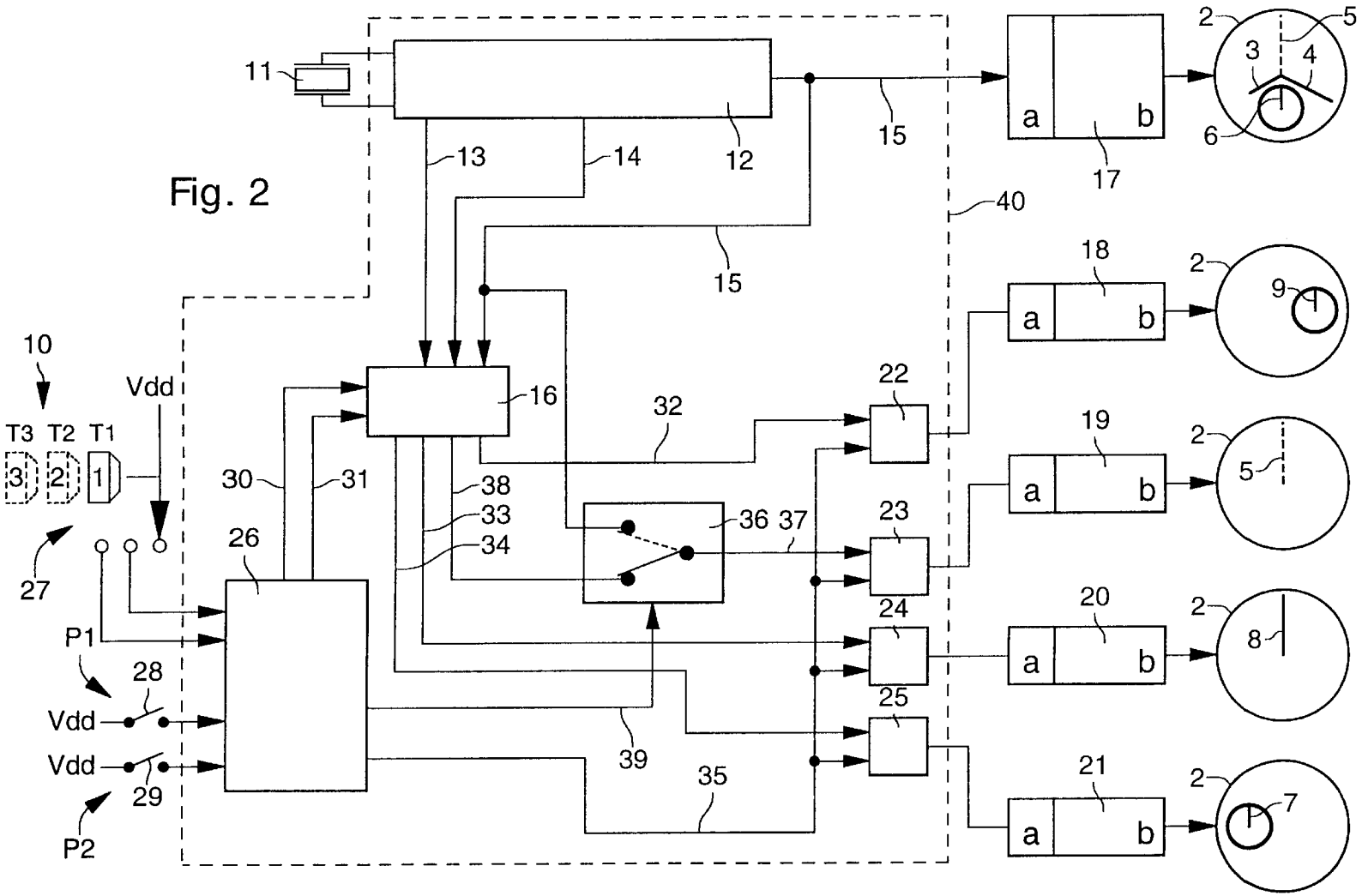

According to the embodiment shown in FIGS. 1 and 2, the chronograph watch 1 according to the invention includes a dial 2 above which, for the current time display, an hour hand 3 and a minute hand 4 which are central and coaxial, can move, as well as a small second hand 6 which is off-centre and situated at six o'clock.

According to the invention, this chronograph watch also includes a central second hand 5, which is coaxial with and superposed onto hour hand 3 and minute hand 4.

During working in normal operating mode, hands 5 and 6 rotate in phase and thus both indicate the second of the current time.

As regards measuring time, the watch of FIG. 1 also includes a small hand 7 for the measured hours, off-centre at ten o'clock, a central hand 8 for the measured minutes, forming part of the superposition of the other central hands 3, 4 and 5, and a hand 9 for the measured tenths of a second off-centre at two o'clock.

According to the invention, the measured seconds are indicated in this watch by central hand 5 which thus fulfils the dual function of selectively indicating the seconds of the current time and the measured seconds.

Having said this, the watch of FIG. 1 also includes a crown 10 with three positions , T1, T2 and T3, respectively corresponding to the neutral position, the time zone setting position and the time setting position, this latter position also stopping indication of the current time.

Two push-buttons P1 and P2 are provided for controlling the timing functions, push-button P1 controlling the starting and stopping of timing, and push-button P2 the reset to zero. Other commands, which are known, may also be allocated to push-buttons P1 and P2.

FIG. 2 shows a very simplified diagram of the chronograph watch which has just been described, this diagram only showing those elements and functions of its electric circuit which are necessary for comprehension of the invention.

A quartz oscillator, which vibrates for example at 32768 Hz and of which only the resonator 11 is shown in FIG. 2, provides the time base of the watch to a frequency divider 12. The latter generates clock pulses intended to drive the electronic functions of the watch on a line 13. Divider 12 also provides tenth of a second pulses on a line 14 and second pulses on a line 15. These lines are connected to a unit 16 for controlling the time measuring functions. Line 15 also transmits the second pulses to a drive unit 17. This drive unit is mechanically coupled to a gear train (not shown) to permanently drive hands 3, 4 and 6 to display the current time.

It should be noted that, in order to illustrate the different roles of the watch hands, several replicas of dial 2 are shown on the right of FIG. 2, with the hand or hands which are driven by an independent drive unit drawn in each of them. These units are respectively indicated by the references 17 to 21, each unit including, as is known, a driver circuit, indicated by "a" and a motor, indicated by "b".

Thus, in addition to the drive unit 17 which drives hands 3, 4 and 6 via the gear train, drive unit 18 drives tenth of a second hand 9, unit 19, central second hand 5, unit 20, minute hand 8 and unit 21, hour hand 7.

Drive units 18 to 21 are associated with respective counters 22 to 25 whose states reflect, at each instant, the angular positions of the hands to which they correspond. Each counter is set at zero when the associated hand is initialised at 12 o'clock and it counts each drive pulse transmitted by time measuring control unit 16. Thus, counter 22 can count up to 10 (tenth of a second), motors 19 and 20 to sixty and motor 21 to twelve.

An input control unit 26 shapes and distributes the control signals supplied respectively by a switch 27 associated with crown 10 and by switches 28 and 29 respectively associated with push-buttons P1 and P2. A command effected by these elements 27 to 29, means, in a known manner, that the potential of one of the terminals (here Vdd) of a power source (not shown), such as a battery incorporated in watch 1, is applied to control unit 26.

As a function of actions on push-buttons P1 and P2, input control unit 26 generates a start/stop timing command signal on a line 30 and a zero reset command signal on a line 31, lines 30 and 31 being connected to time measuring control unit 16.

Unit 16 generates control pulses intended for counters 22, 24 and 25 respectively on lines 32 to 34. These counters may also be directly positioned by input control unit 26 through a control line 35.

A switching unit 36 is connected via a control line 37 to counter 23 responsible for co-operating with drive unit 19 for central second indication hand 5. This switching unit 36 is connected on the one hand directly to divider 12 via line 15 over which the second pulses of the current time are transmitted, and on the other hand to control unit 16 via a line 38 over which the timed second pulses are transmitted. This switching unit 36 receives inversion instructions from input control unit 26 via a line 39.

Thus, as a function of the switching signal transmitted over line 39, the rotation of second hand 5 may be selectively subordinated to the second pulses of the current time (line 15) or to the second pulses of the measured time (line 38). This is why, to the right of FIG. 2, hand 5 is shown in dotted lines in two diagrams of dial 2.

All the functions performed by the watch which has just been described will preferably be executed by a micro-controller which those skilled in the art will know how to programme appropriately using the description which has just been made and that which now follows regarding the operation of the watch. This micro-controller is globally designated by the reference 40 in FIG. 2.

During operation in the current time mode, the watch rotates hands 3, 4 and 6 via drive unit 17 controlled by the second pulses being transmitted over line 15. Hand 5 rotates synchronically with hand 6, the switching unit connecting this line 15 to line 37 to control drive unit 19. The user is thus able to read the second of the current time clearly via hand 5.

When the watch is set to the time measuring function via pressure on push-button P1, input control unit 26 commands the inversion of switching unit 36 by line 39 and time measuring control unit 26 very quickly sends pulses to drive unit 19 to return hand 5 to the twelve o'clock position, if it is not already there, at sufficient speed to avoid adversely affecting the accuracy of the measured time. Immediately afterwards, unit 16 applies the appropriate control signals to lines 33, 34 and 37 so that respectively via counters 24, 25 and 23 and drive units 20, 21 and 19, hands 7, 8 and 5 display respectively the measured time.

During this time, counter 22 receives pulses of a tenth of a second but drive unit 18 remains inactive and hand 19 still.

Renewed pressure on push-button P1 stops the timing, without the position of switching unit 36 being modified. Hands 5, 7 and 8 stop, while drive unit 18 is activated by time measuring control unit 16, so that hand 9 moves forward to the angular position corresponding to the number of tenths of a second counted at the moment that timing was stopped.

When push-button P2 is activated for the reset to zero, hands 7, 8 and 9 are repositioned at zero. Further, input control unit 26 commands the inversion of switching unit 36 and time measuring control unit 16 sends pulses to counter 23 and drive unit 19 so that hand 5 quickly returns to the angular position which second hand 6 has at that instant. The number of angular steps of this movement may be calculated by subtraction modulo 60 of the content of the second counter (not shown) of hand 6 and the content of counter 23. This function is programmed into micro-controller 40.

It will be noted that during timing, hand 6 has continued to indicate the seconds of the current time. Consequently, the user continues to have available information as to the second of the current time, while the timing function is being performed.

Figure 3:
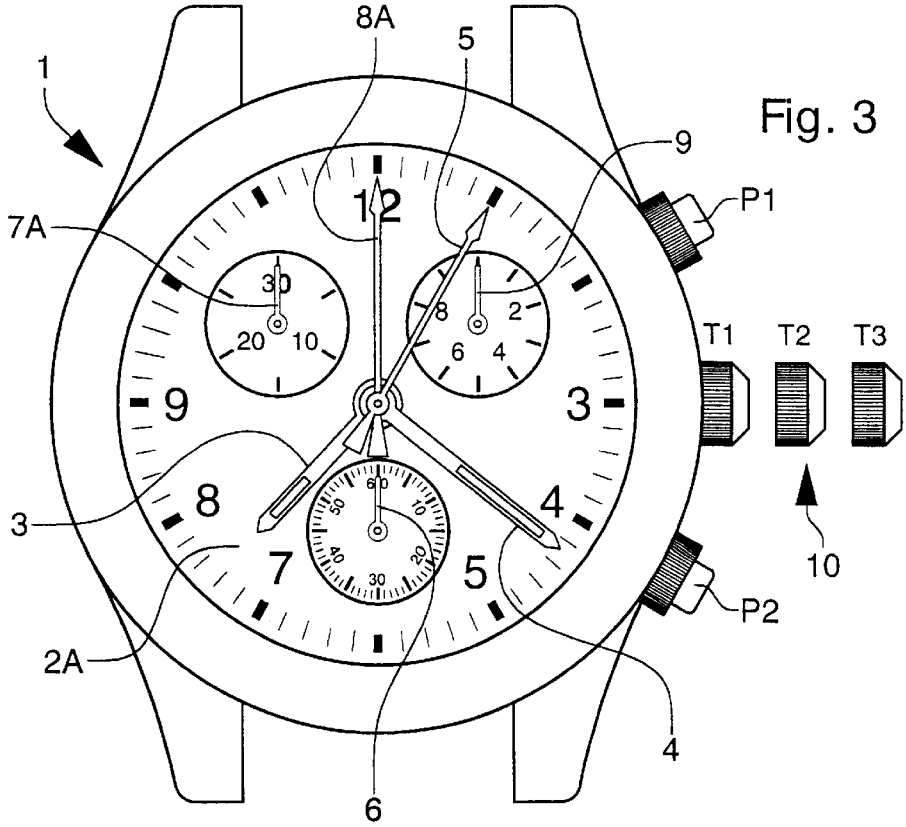
FIGS. 3 and 4 show similar illustrative elements, but relating the an electronic chronograph-watch-according to a second embodiment of the invention.
Figure 4:
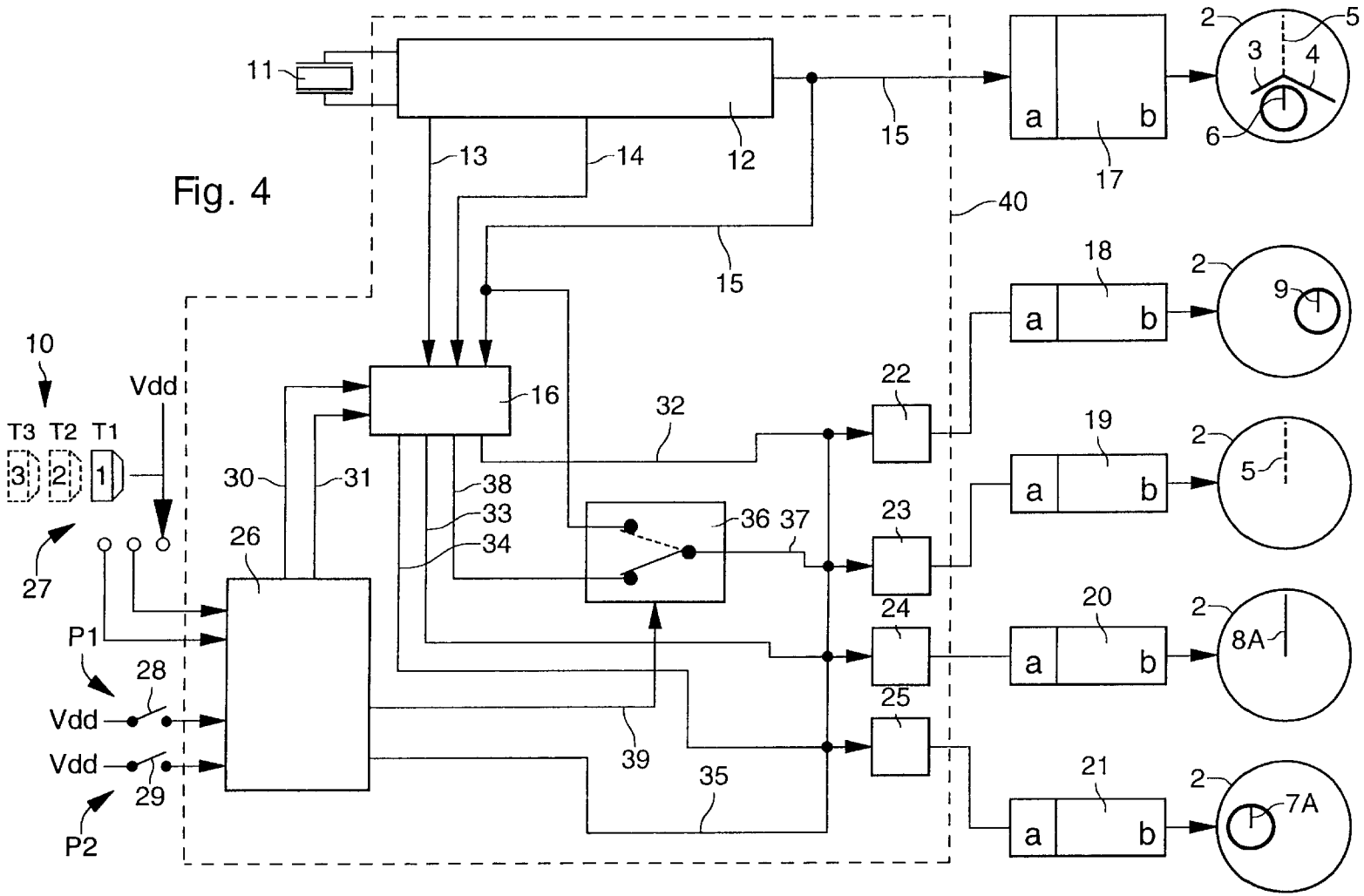

The embodiment shown in FIGS. 3 and 4 differs to that of FIGS. 1 and 2 in that the display functions of hands 7 and 8 are replaced by those of respective hands 7A and 8A of which the first, 7A, indicates the measured minutes, for example over 30 minutes and the second, 8A, the measured seconds.

The programming of the micro-controller must of course be adapted accordingly.

In this case, hand 5 keeps its dual role of displaying the seconds of the current time in phase with second hand 6 to assure that the seconds can be easily read during operation in current time mode and of displaying the measured seconds in timing mode, hand 5 being then superposed onto hand 8A so as to avoid disturbing the readability of the measured seconds. During execution of this function, hand 6 continues to display the second of the current time.

When, in this case, the timing function is started by an action on push-button P1, hand 5 is quickly superposed onto hand 8A. The display of the measured time is then assured by minute indication hand 7, tenth of a second indication hand 9 and by second indication hands 5 and 8A in superposition. As in the preceding case, hand 5 is driven after switching unit 36 has changed state, at the command of the timed second pulses being transmitted over lines 38 and 37 and via counter 23. Renewed pressure on push-button P1 stops the timing and hand 9 is quickly positioned to indicate the measured tenths of a second counted from the moment that timing stopped.

Upon reset to zero via pressure on push-button P2, hands 7A, 8A and 9 return to the start position, while hand 5 quickly returns to the phased position with hand 6 after switching unit has changed state, line 37 being again connected to line 15 on which the second pulses of the current time are transmitted.

Naturally, as in any watch where one or more hands have to display different data according to the mode in which the watch is operating and where the watch does not include a non volatile memory for storing the position of said hands when the power source is exhausted, it is necessary to reinitialise the position of the hands when the power source is changed or recharged.

For the embodiments of the watch according to the invention which have just been described, such reinitialisation may be achieved via particular combined positions of crown 10 and push-buttons P1 and P2, so as to return small second hand 6, centre second hand 5 and in the first case (FIGS. 1 and 2) chronograph minute hand 8 and in the second case centre chronograph second hand 8A to twelve o'clock.

This reinitialisation will not be described in detail here since it depends, on the one hand, on the way in which micro-controller 40 is programmed and, on the other hand, because this reinitialisation is entirely accessible to those skilled in the art, since it is necessary in numerous multi-functional watches which are currently known.

On the other hand, it should be noted that by making minor modifications to the programming of micro-controller 40, hand 5 could act as the fly-back hand in the second embodiment of the invention.

Of course, the invention is not limited to the embodiments described. In particular, the positions of the various graduations and those of the associated hands may be chosen differently as a function of the desired appearance of the watch.

What is claimed is:

1. An electronic chronograph watch including:

a central hour hand, a central minute hand and a small off-centre second hand for permanently indicating the current time;

chronograph hands for indicating a measured time when the watch is operating in chronograph mode;

drive means operatively connected to the central hour hand, the central minute hand, the small off-centre second hand and said chronograph hands for driving the connected hands;

generator means responding to manual control means for applying control pulses to said drive means, the generator means being operatively connected to the drive means, the drive means being responsive to the control pulses; and a first central second hand driven by its own drive unit, the drive unit being operatively connected to the first central second hand and being a member of the drive means and said generator means including means for selectively applying control pulses to the drive unit so that said first central second hand indicates the seconds of the current time, in phase with said small off-centre small second hand, when the watch is operating normally and the measured seconds when the watch is operating in chronograph mode.

2. A watch according to claim 1, wherein the chronograph hands include: a small off-centre hour hand, a large central minute hand and a small off-centre tenth of a second hand.

3. A watch according to claim 2, wherein said drive means includes a first drive unit for driving the small off-centre hour hand, a second drive unit for driving the large control minute hand and a third drive unit for driving the small off-centre tenth of a second hand.

4. A watch according to claim 1, wherein the chronograph hands include: a small off-centre minute hand, a small off-centre tenth of a second hand and a second central second hand, said second central second hand rotating in superposition with said first central second hand when the watch is operating in chronograph mode.

5. A watch according to claim 1, wherein said drive means includes a common drive unit, and a mechanical coupling for coupling the common drive unit to the central hour and minute hands and said off-centre second hand.

6. An electronic chronograph watch including:

a set of current time hands for permanently indicating the current time including central hour and minute hands;

a set of chronograph hands for indicating a measured time when the watch is operating in chronograph mode;

drive means operatively connected to the set of current time hands and said set of chronograph hands for driving the connected hands;

generator means responding to manual control means for applying control pulses to said drive means, the generator means being operatively connected to the drive means, the drive means being responsive to the control pulses; and wherein the current time hands includes an off centre second hand and the watch further includes a first central second hand, the drive means includes a first drive unit, the first drive unit being operatively connected to the first central second hand and said generator means includes means for selectively applying control pulses to the first drive unit so that said central second hand indicates the seconds of the current time, in phase with said off-centre small second hand, when the watch is operating normally and the measured seconds when the watch is operating in chronograph mode.

7. The watch according to claim 6, wherein the set of chronograph hands include: a small off-centre hour hand, a large control minute hand and a small off-centre tenth of a second hand.

8. The watch according to claim 7, wherein said drive means includes a second drive unit for driving the small off-centre hour hand, a third drive unit for driving the large control minute hand and a fourth drive unit for driving the small off-centre tenth of a second hand.

9. The watch according to claim 6, wherein the set of chronograph hands include: a small off-centre minute hand, a small off-centre tenth of a second hand and a second central second hand, said second central second hand rotating in superposition with said first central second hand when the watch is operating in chronograph mode.

10. The watch according to claim 6, wherein said current time hands include a central hour and minute hands and an off-centre second hand and the drive means includes a common drive unit, and a mechanical coupling for coupling the common drive unit to the central hour and minute hands and said off-centre second hand.

* * * * *